United States Patent [19]

Porter et al.

[11] Patent Number: 4,610,356

[45] Date of Patent: Sep. 9, 1986

[54] CHRISTMAS TREE PACKAGING SYSTEMS AND STANDS

[75] Inventors: Stanley P. Porter, Dallas, Tex.; John H. Williams, Tulsa, Okla.; William W. Avery, Plumtree, N.C.

[73] Assignee: Fraser Firs For Christmas, Newland, N.C.

[21] Appl. No.: 656,014

[22] Filed: Sep. 27, 1984

[51] Int. Cl.[4] ..... B65D 85/00; B65D 85/52

[52] U.S. Cl. ..... 206/423; 47/40.5; 47/84; 248/523; 248/529

[58] Field of Search ..... 47/39, 40.5, 42, 43, 47/72, 84; 206/423, 804; 248/146, 154, 346, 523–529; 428/18–20

[56] References Cited

U.S. PATENT DOCUMENTS

| | | | |
|---|---|---|---|
| 760,886 | 5/1904 | Lord | 206/423 |
| 1,317,501 | 9/1919 | Huseby | 206/804 |
| 1,421,340 | 6/1922 | Zelazo | 47/40.5 |
| 1,606,523 | 11/1926 | Gardner | 206/423 |
| 1,721,980 | 7/1929 | Wardell | 47/40.5 |
| 2,750,138 | 6/1956 | Morris | 206/423 |
| 2,830,405 | 4/1958 | Nydegger | 206/423 |
| 2,934,204 | 4/1960 | Pardee | 206/423 |
| 3,033,505 | 5/1962 | Brown | 47/40.5 |
| 3,142,464 | 7/1964 | Zelenitz | 248/529 |
| 3,231,226 | 1/1966 | Rossler | 47/40.5 |
| 3,272,462 | 9/1966 | Apple | 47/40.5 |
| 3,342,329 | 9/1967 | Knight | 206/423 |
| 3,862,733 | 1/1975 | Sullivan | 248/529 |
| 4,118,890 | 10/1978 | Shore | 206/423 |
| 4,126,963 | 11/1978 | Dunbar | 248/523 |
| 4,170,301 | 10/1979 | Jones et al. | 206/423 |
| 4,261,138 | 4/1981 | St. George Syms | 47/40.5 |

FOREIGN PATENT DOCUMENTS

| | | | |
|---|---|---|---|
| 1429968 | 5/1973 | Fed. Rep. of Germany | 47/40.5 |
| 0611809 | 10/1960 | Italy | 206/423 |
| 0209902 | 1/1924 | United Kingdom | 206/423 |
| 1186264 | 4/1970 | United Kingdom | 206/423 |

*Primary Examiner*—William Price
*Assistant Examiner*—Jimmy G. Foster
*Attorney, Agent, or Firm*—Richards, Harris, Medlock & Andrews

[57] ABSTRACT

Christmas tree stands and packaging systems for the distribution of Christmas trees. The packaging system includes an elongated receptacle and a Christmas tree contained within the receptacle. A stand base is secured to the trunk of the Christmas tree at the butt end thereof. The packaging system is provided with means securing the base and tree within the receptacle in a manner to prevent relative longitudinal movement between the tree and the receptacle when the packaging system is in transit. The securing means fastens the base to the receptacle in a manner to prevent movement of the base toward the tip end of the receptacle while permitting the base and tree to be withdrawn from the receptacle when the butt end of the receptacle is opened. The stand base comprises a bottom pan portion and a peripheral rim portion so that the base is adapted to contain water. A peg extends upwardly from the pan portion and is provided with an axial bore therethrough from the underside to the top of the peg. A bolt is receivable within the peg to secure a tree having an axial bore in the butt end thereof to the stand.

21 Claims, 14 Drawing Figures

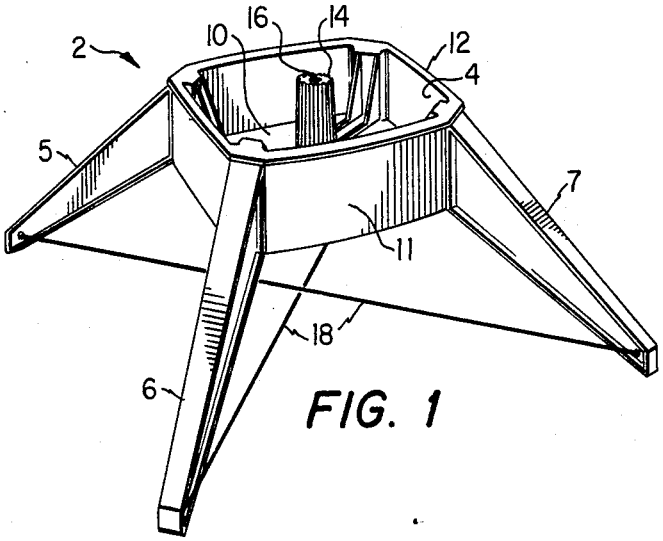
FIG. 1
FIG. 2
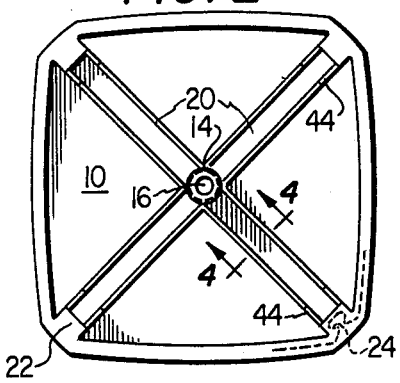
FIG. 3
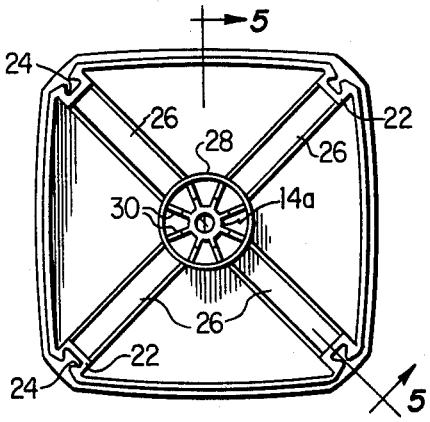
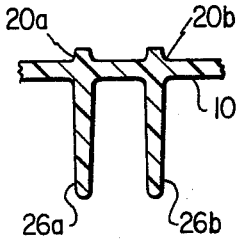
FIG. 4
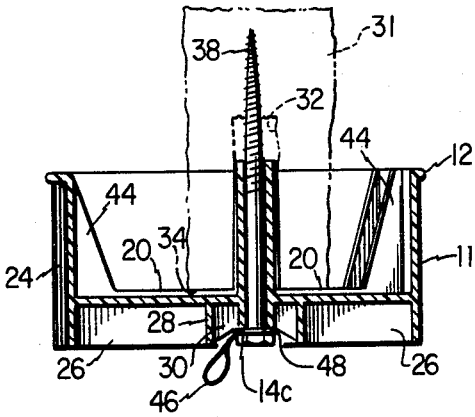
FIG. 5

FIG. 11
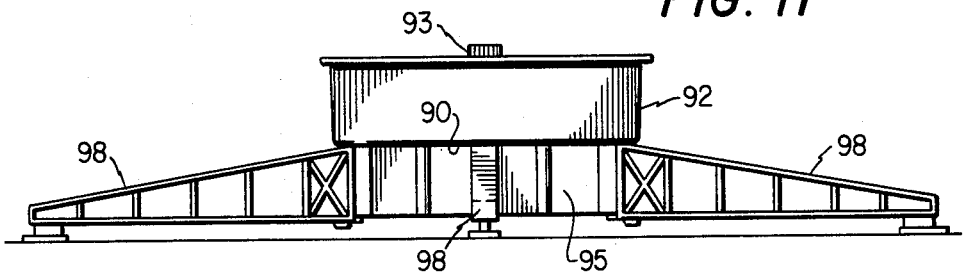
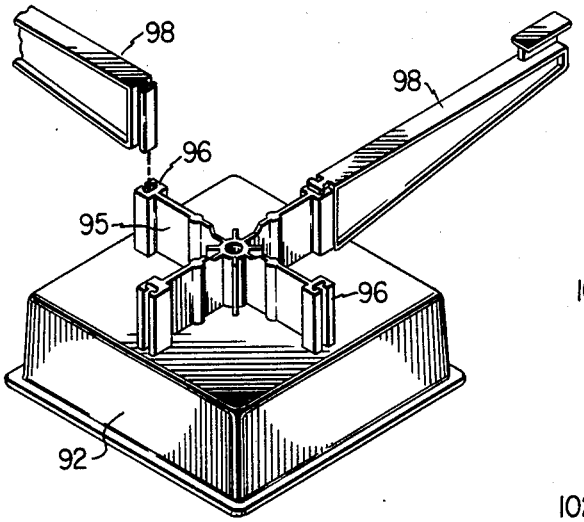
FIG. 12
FIG. 13
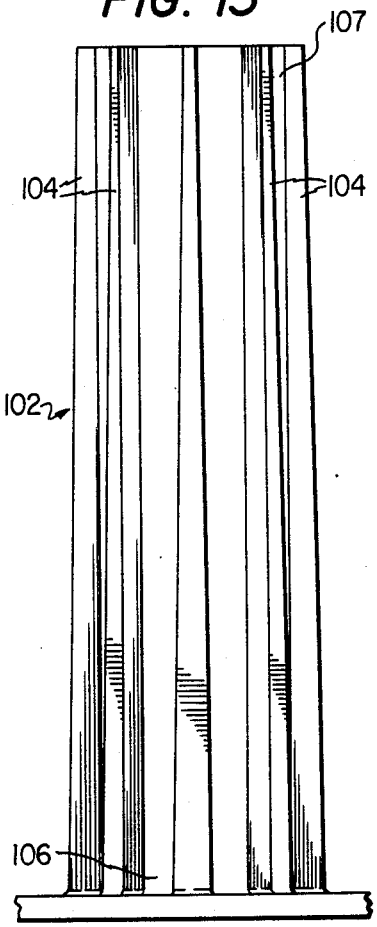
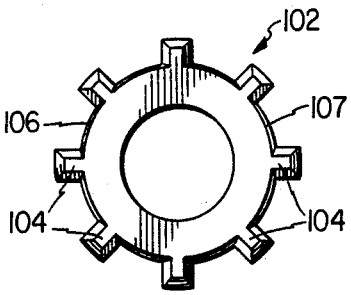
FIG. 14

CHRISTMAS TREE PACKAGING SYSTEMS AND STANDS

TECHNICAL FIELD

This invention relates to the packaging and display of Christmas trees and more particularly to Christmas tree stands and packaging systems useful in the distribution of Christmas trees.

BACKGROUND ART

It is a conventional practice to fabricate Christmas tree stands of relatively lightweight, low-strength materials such as plastic and the like by employing designs which impart structural stability to the stands. For example, U.S. Pat. No. 3,862,733 to Sullivan discloses a knockdown Christmas tree stand comprising a base panel and a plurality of detachable legs which may be connected to the base panel in an interlocking relationship permitting the assembled stand to support a relatively great weight. The legs are connected to the periphery of the stand base by means of key-type joints in which a peg associated with each leg fits into a corresponding receptacle on the stand. The base panel of the stand is equipped with an upstanding tubular socket adapted to receive a Christmas tree base or the like. A plurality of rib members extend radially outwardly from the socket to terminate at locations associated with the receptacles of the key-joint connections between the base and the legs. The legs extend outwardly and downwardly from the base so that the base of the stand is held above the floor upon which the stand rests.

U.S. Pat. No. 4,126,963 to Dunbar discloses a Christmas tree stand comprising a base formed of a bottom pan member equipped with a peripheral rim which forms a receptacle suitable for containing water. The center of the base is provided with a cone shaped peg which extends upwardly from the bottom pan member of the base. The peg is tapered at an angle comparable to that of a conical hole which is drilled into the butt end of the tree to be supported upon the peg. The diameter of the peg near its bottom is greater than the diameter of the tapered hole in the butt end of a tree so that the tree, when in placed on the stand, is held off the bottom of the pan, thus rendering the butt end of the tree accessible to water in the base. The cone-shaped peg functions to support the entire weight of the tree and to hold the tree in a properly aligned vertical position. The outer surface of this peg is made uneven through the provision of grooves or ridges in order to provide a space between the conforming tree and peg surfaces to allow water to move upwardly into the tapered hole in the butt end of the tree. In one embodiment disclosed in Dunbar, the upper surface of the bottom pan portion is provided with ribs in the form of inverted channels which extend from the central peg out to the rim of the stand. The rim supports the stand on the floor and is provided with apertures that are adapted to receive screws to hold the stand in place. Intermediate each of the ribs on the upper surface of the pan are relatively small ribs extending downwardly from the underside of the pan which function with the upper ribs to impart rigidity to the stand. In another embodiment disclosed in Dunbar, the stand, while supported by virtue of the base member resting on the floor, is also provided with radially extending legs secured to the stand base by means of tongue and groove connections. In this embodiment also, the vessel is provided with radial ribs which add structural rigidity to the stand as well as providing support for the central peg.

A simple base formed from a section of a tree trunk with a hole drilled through the center is disclosed in U.S. Pat. No. 1,150,708 to Schlecht which also discloses a technique for the packaging and transportation of Christmas trees. In this procedure, a Christmas tree is frozen and then thawed out in order to increase the flexibility of its limbs. The tree thus treated, in addition to the simple stand described above, is inserted butt end into an elongated receptacle so that the walls of the receptacle compress the limbs of the tree inwardly against the trunk. After being transported to the desired location, the receptacle is then opened at the opposite end (adjacent the butt end of the tree) and the tree is withdrawn and mounted on the stand.

A somewhat more sophisticated packaging technique is disclosed in U.S. Pat. No. 2,720,055 to Morris. In this case, the tree is similarly packaged in a long narrow receptacle by means which grasp the tree at its butt end and draw it into the receptacle. The receptacle may be equipped with a cone-shaped member which functions to arrange and compress the limbs against the trunk of the tree as it is drawn into the receptacle. The butt end of the tree may be provided with a container containing a moist lining such as peat moss or sawdust in order to provide moisture to the tree while in transit.

DISCLOSURE OF THE INVENTION

In accordance with the present invention there are provided new and improved packaging systems for Christmas trees and Christmas tree stands useful in such packaging systems. In one aspect of the invention, there is provided a Christmas tree packaging system which comprises an elongated receptacle having a Christmas tree contained therein. A stand base is secured to the trunk of the Christmas tree at the butt end thereof. Means are provided for securing the stand base and the tree in the receptacle in a manner preventing relative longitudinal movement between the tree and the receptacle during transportation of the packaging system. In a specific embodiment of the invention, the securing means comprises one or more straps which extend transversely through the receptacle from one side thereof to another side at a location adjacent the butt end of the receptacle. The straps secure the stand base against the butt end of the container, thus preventing movement of the stand base away from the butt end of the receptacle while at the same time permitting withdrawal of the stand base and the attached tree from the butt end of the receptacle when it is opened. In yet a further aspect of the invention, the receptacle is of a polygonal transverse configuration. The stand base is also a polygonal configuration conforming at least partially to the container configuration in a manner to secure the stand base and the tree attached thereto against relative rotational movement about the axis of the container. Preferably the stand base also comprises means extending downwardly from the bottom thereof which may be readily grasped by the recipient of the packaging system in order to withdraw the base and the tree from the receptacle. The legs are disposed in the receptacle in a non-operative position and extend longitudinally within the receptacle between the stand base and the tip end of the receptacle.

In yet a further aspect of the invention, there is provided a new and improved Christmas tree stand of the type adapted to support a Christmas tree in the presence of water contained therein. The stand, while useful in other applications, is particularly well adapted for use in conjunction with packaging systems of the type described above. The stand comprises a base having a bottom pan portion and a peripheral rim portion whereby the stand base forms a water receptacle. A central peg extends upwardly from the pan portion of the base. The peg is provided with an elongated axial bore which extends through the peg from the underside of the pan portion to the top end thereof. A bolt is receivable within the bore when the tree is in place on the stand with the peg extending upwardly into a hole drilled into the butt end of the tree. The bolt is longer than the peg bore whereby, when the tree is in place, the bolt protrudes from the upper end of the peg and into the trunk of the tree to secure the tree to the stand. Thus, the bolt, when tightened, functions to force the butt end of the tree downwardly against the pan portion. In a further embodiment of the invention, the packaging system comprises a plurality of legs for the stand base. Preferably the peg extends to a location above the lip of the peripheral rim.

BRIEF DESCRIPTION OF THE DRAWINGS

FIG. 1 is a perspective view of a Christmas tree stand embodying the present invention;

FIG. 2 is a top view of the base, with legs detached, of the stand shown in FIG. 1;

FIG. 3 is a bottom view of the stand base shown in FIG. 2;

FIG. 4 is a sectional view taken along line 4—4 of FIG. 2;

FIG. 5 is a staggered sectional view taken along line 5—5 of FIG. 3;

FIG. 11 is a side elevation of illustrating a Christmas tree stand formulated in accordance with another embodiment of the invention;

FIG. 12 is a bottom perspective view of a portion of the Christmas tree stand of FIG. 11;

FIG. 13 is a side elevation of a preferred form of peg embodied in the present invention; and FIG. 14 is a plan view of the peg illustrated in FIG. 13.

DETAILED DESCRIPTION

Figure 6:
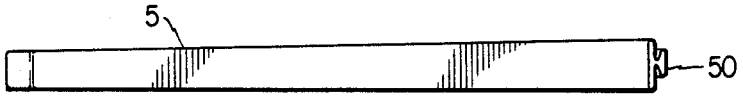
FIG. 6 is the top view of a detachable leg of the stand shown in FIG. 1.

Turning first to FIG. 1, there is illustrated a Christmas tree stand 2 comprising a base 4 and a plurality of legs 5–8. The base portion of the stand comprises a pan portion 10 and a peripheral rim 11 which together with the pan portion forms a receptacle for water. The rim 11 is provided with an upper lip or flange 12 which imparts structural rigidity to the rim and also provides support for the connection between the legs and the stand base as described hereinafter. The base also is provided with a peg 14 which fits into a conforming hole drilled into the butt end of a Christmas tree as described below. A bore 16 extends through the peg from the bottom end to the top end thereof and provides a means of securing the tree to the stand. Tension means are provided to connect opposing pairs of legs in order to provide added strength to the stand when it is in the assembled position shown and supporting a tree. Thus as illustrated in FIG. 1, the tension means comprises a wire 18 secured between legs 5 and 7. The wire is, of course, stressed in tension to prevent the legs from spreading when a load is imposed upon the stand.

FIG. 2 is a top plan view of the base portion (without the legs attached) of the stand illustrated in FIG. 1. As shown in FIG. 2, the pan portion 10 of the base is provided with ribs 20 which extend radially outward from the peg 14 to each of the corners of the base to which the legs are attached. The corners are provided with thickened sections 22 which are provided with vertically extending grooves 24, as described in greater detail hereinafter, to which the legs are attached.

FIG. 3 is a bottom view of the base illustrated in FIG. 2. As shown in FIG. 3, the bottom side of the pan portion is also provided with ribs 26 extending radially outward from the center of the stand to the corners to which the legs are attached. Surrounding the downward extension **14*a* of the peg 14 is a cylindrical projection 28 which serves to strengthen the base and also, optionally, is a means for grasping the stand to withdraw it from its receptacle when the tree is delivered in a packaging system as described in greater detail hereinafter. Secondary ribs 30 extend between the outer surface of the peg extension and the surrounding cylindrical projection in order to provide rigidity to the bottom portion of the base structure and the peg 14. As illustrated in FIG. 3, each corner of the base is provided with a vertically extending grooved receptacle 24** into which the corresponding key member of a leg fits when the legs are attached to the stand.

The compound nature of the preferred rib configuration and the relative dimensions of the upper and lower ribs are illustrated in FIG. 4. More particularly as shown in FIG. 4, the upper rib 20 comprises two rib sections **20*a* and 20*b* which conform to the lower rib sections 26*a* and 26*b* which form the compound rib 26. As illustrated in FIG. 4, the upper ribs are of substantially less depth than the lower ribs. The reason for the relative differential dimensions between the upper and lower ribs will become apparent from the following discussion with reference to FIG. 5**.

FIG. 5 is a cross sectional view of the stand base taken along lines 5—5 of FIG. 3 and illustrating schematically a tree trunk 30 supported upon the base. More particularly as shown in FIG. 5, the tree trunk 30 is provided with a hole 32 drilled along its axis from the cut butt end surface 34 of the trunk. The hole is of sufficient length to accommodate the peg 14 when the butt end of the tree rests upon the upper ribs 20. A bolt 38 extends upwardly through the bore 16 within the peg and is threaded into the tree trunk as illustrated. Preferably the bolt extends into the body of the tree trunk by a distance of at least 1 to 3 inches and preferably 2–3 inches in order to securely fasten the tree trunk to the stand. The upper ribs 20, in addition to imparting some structural rigidity to the base including support for the peg 14, also function to hold the butt end of the tree off of the upper surface of the pan portion to provide a clearance between the upper surface of the pan 10 and the butt end of the tree. This enables water to readily flow under the butt end of the tree. Water leakage will not occur at the junction of the peg and the pan since the peg is formed integrally with the base. By providing the top ribs with a relatively small vertical dimension relative to the bottom ribs, optimum exposure of the tree trunk to the water within the base is achieved. For example, the top ribs 20 may have a vertical dimension of about $\frac{1}{8}$ inch as contrasted with a vertical dimension for the bottom ribs 26 of about 1 inch. The small vertical dimension of the upper ribs minimizes the "dead space" in the water section, that is, the water below the butt end of the tree which is not accessible to the tree.

As shown in FIG. 5 the sawed end surface 34 is desirably a square cut, i.e. at an angle of 90° with respect to the axis of the tree, so that the bearing area of the tree on the stand is supported about the periphery of the peg 14. This enables the bolt 38 to be tightened to pull the tree down on the upper ribs without imparting a localized eccentric stress to the stand as would occur in the case of an oblique cut as shown, for example, in the aforementioned patent to Dunbar. The relatively uniform distribution of the stress relationship between the tree and the stand minimizes the likelihood that the base will crack, not only during use, but also during shipping of the tree within the packaging container as described hereinafter.

As also illustrated in FIG. 5, the upper ribs 20 terminate in upwardly extending flanges or wings 44 which function to strengthen the rim portion and also to provide bending support in the structure when the stand is supported on the downwardly extending legs as described hereinafter.

The bolt 38, in addition to fastening the tree securely to the stand, also functions to provide a support for a loading ring 46 which can be employed to draw the tree into its receptacle as described hereinafter. By way of example, the ring 46 may take the form of a flexible loop which is held in place underneath a washer 48 between the bottom shoulder 14*c* of the peg 14 and the head of the bolt. It will be recognized that a rope or other means can be secured through the loop to pull the tree into the container. The stress in this case will be carried by the bolt threaded into the tree trunk rather than by the stand base. The loop can be left in place after packaging of the tree to provide a means for the recipient to withdraw the tree from the receptacle. Alternatively, the projecting cylindrical member 28 can be grasped by the recipient to withdraw the tree from its container.

It will be noted from FIG. 5, that the peg 14 extends above the top of the rim 11. This relationship is advantageous in that it reduces the chance that water will leak from the stand through the bore through which the bolt extends even when the stand receptacle is filled to its limit. The peg may be of any suitable configuration. As a practical matter, it will be preferred to provide a relatively cylindrical peg member which is either an exact cylinder or which may tapered slightly inwardly toward the top to facilitate entry of the peg into the hole drilled into the trunk of the tree. The peg may be provided with grooves or ribs such as disclosed in the aforementioned patent to Dunbar in order to provide spaces facilitating flow of water upwardly into the hole drilled into the butt end of the tree. However, it is preferred that the outer surface of the peg and the inner surface in the wall of the hole within the tree be in a close conforming relationship to prevent, or at least minimize, the entry of water into the axial bore 32 extending into the butt end of the tree. This relationship is desirable in order to reduce the likelihood of leakage of water from the stand when in use. Furthermore, should water enter between the wall of the bore 32 and the exterior surface of the peg, the fact that the peg 14 extends above the top of the rim would prevent a column of water within the tree bore, due to the hydrostatic head of water within the stand, reaching the top of the peg where it could leak through the hole accommodating the bolt.

Figure 7:
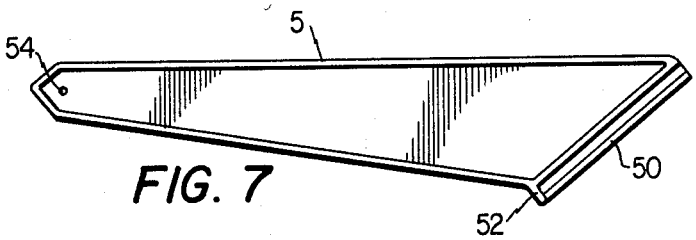
FIG. 7 is a side view of the leg shown in FIG. 6.

The details of the legs are illustrated in FIGS. 6 and 7. FIG. 6 is a plan view of a leg 5 illustrating the tongue or key member 50 which is adapted to fit into a receptacle groove 24 (FIG. 3). FIG. 7 is a side view of leg 5. As illustrated, the elongated tongue 50 terminates in a bottom flange 52 which abuts against the bottom edge of the peripheral rim 11. This engagement, plus the engagement of the top portion of the tongue structure 50 against the underside of lip 12 secures the leg against vertical movement relative to the stand base. As also shown in FIG. 7, the end of the leg is provided with a perforation 54 through which a wire may be inserted to provide a tensioning means preventing spreading of the legs as described previously with respect to FIG. 1.

Figure 8:
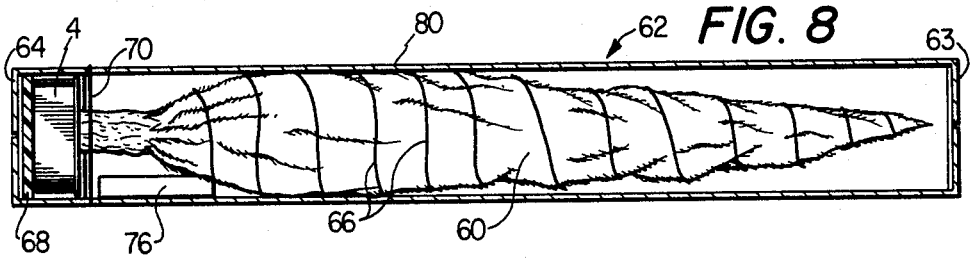
FIG. 8 is a schematic view in side elevation, with parts broken away, of a receptacle containing a Christmas tree packaged in accordance with the present invention.

FIG. 8 illustrates the packaging system of the present invention. As shown in FIG. 8, a Christmas tree 60 is secured to a stand base 4 and contained within an elongated receptacle 62. Receptacle 62 is characterized by a tip end 63 and a butt end 64. Receptacle 62 may take the form of a cardboard carton with its ends closed by flaps, as will be understood by those skilled in the art. In assembling the system shown in FIG. 8, the tree is connected to the stand base and inserted butt end first into the tip end of the receptacle. Preferably the tree is first wrapped relatively tightly with a cord 66 in order to secure the branches of the tree inwardly in a compressed state against the trunk of the tree. The cord thus provides means for securing the branches independently of the container and reduces the likelihood of damage to the limbs during insertion of the tree into the receptacle. In addition, by securing the branches of the tree inwardly in a compressed state against the trunk of the tree, removal of the tree from the receptacle is facilitated.

In loading the tree into the receptacle, the stand and the attached tree are pulled through the receptacle by means of a cord or other tensioning means secured to the loading ring 46 (FIG. 5). The tree is pulled to the position shown in FIG. 8 and a packing member 68 such as a piece of cardboard or foamed plastic is then inserted against the lower end of the stand base. Both ends of the receptacle are then closed.

It will be recognized that the receptacle may be of any suitable configuration. As a practical matter, it usually will be simply in the form of a cardboard box which is square in cross section. After insertion of the tree within the receptacle, one or more straps 70 are passed transversely through the receptacle from one side to the other. The straps 70 are located so as to maintain the stand base in a relatively "locked" relationship against the packing member 68 so that it and the attached tree will not move longitudinally relative to the receptacle. This prevents damage to the tip end of the tree such as may occur if the tree were allowed to move freely. This relationship also reduces the likelihood of damage to the stand.

Figure 9:
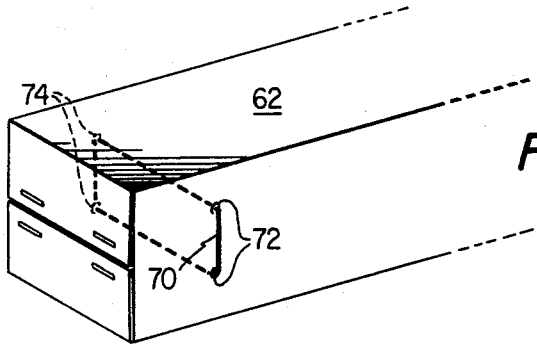
FIG. 9 is a perspective view of one end of the receptacle shown in FIG. 8 illustrating securing means.

As illustrated in the perspective view of the butt end of the receptacle shown in FIG. 9, a strap 70 may simply be inserted through holes 72 in one side of the receptacle and extend through the interior of the receptacle and exit through holes 74 on the other side. The ends of the strap can then be secured by any suitable means.

It will be recognized that in the case of a stand base which is of a generally square configuration as shown in FIGS. 2 and 3, the transverse configuration of the receptacle 62 may be similarly formed so that the conforming shapes between the base and the receptacle prevent rotational movement of the stand, and thus the tree, relative to the receptacle. This relationship also minimizes the likelihood of damage to the tree during transit.

The detachable relationship between the legs 5–8 and the stand base 4 allows the legs to be packaged in a non-operative position where they are located within the longitudinal interval between the base 4 and the tip end 63 of the container. Thus, as illustrated in FIG. 8, the legs are secured together in a package 76 and placed in the receptacle above the base 4. This allows a tree of maximum length to be carried within a receptacle of any given length and eliminates dead storage space such as would be present if the legs depended below the base during storage and transit.

While in the preferred embodiments described herein, detachable legs are employed, it is to be recognized that articulated leg structures may be employed so that the legs, rather than being detached from the stand, are pivoted into the non-operative position. In order to avoid the presence of dead storage space, it will be preferred that the legs in this case pivot upwardly so that when in the packaged state they extend longitudinally between the base and the tip end of the receptacle.

Figure 10:
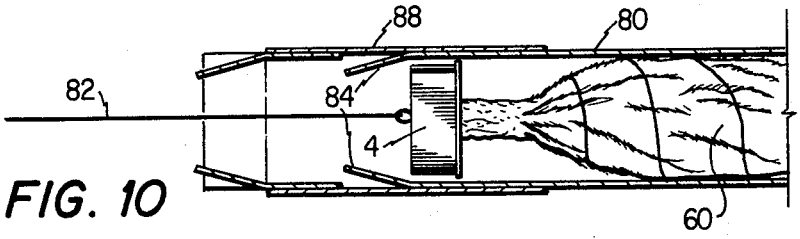
FIG. 10 is a side elevation partly in section showing the butt end of a receptacle with another means of securing the stand base within the receptacle.

Means other than straps may be employed to secure the base and the tree against longitudinal movement relative to the receptacle. Such means should, similarly as in the case of the strap means, permit movement of the stand base through the butt end of the receptacle when this end of the receptacle is open. An alternative means for securing the stand base within the receptacle is illustrated in FIG. 10. FIG. 10 shows the butt end of a receptacle 80 with the base 4 and attached tree 60 at an intermediate location during loading of the tree into the receptacle. As shown, the tree is being drawn into the receptacle by means of a rope or cable 82. The opposed walls of the receptacle are cut to provide flaps 84 which are biased inwardly somewhat relative to the wall structure 86. For example, the receptacle may be a simple cardboard box of a square configuration with two sides cut to provide the inwardly biased flaps 84 as shown. The butt end of the cardboard box is provided with a secondary sleeve 88 in order to strengthen the receptacle. As the tree is pulled past the flaps, the flaps will be biased outwardly and then, when the stand reaches its position adjacent the butt end of the receptacle, the flaps will move back inward thus retaining the stand base against movement toward the tip end of the receptacle. At this point, the cable 82 can be disconnected from the stand base and the receptacle closed with suitable packing as described previously.

From the foregoing description it will be recognized that the stand structure embodying the present invention is particularly well suited to use in packaged tree systems which may be subject to rough treatment during transit. By supporting the tree on the stand by virture of the peg and with the bolt pulling the tree down on the upper surface of the pan portion of the stand base (specifically on the ribs 20 in the preferred embodiment) the likelihood of a bending stress being imposed upon the peg which would cause the peg to break is reduced. The load imposed by the tree is spread throughout the stand rather than being concentrated on the peg. In addition, the cylindrical projection 28 and the associated secondary ribs 30 tend to provide structural support in the stand for the stress imposed upon the stand when the bolt is tightened into the tree. The recessed termination of the peg extension **14*a* relative to the projecting cylindrical portion 28** accommodates the head of the bolt, thus reducing the likelihood that the bolt will tear up the end of the packing member or the box at the butt end of the box.

The base illustrated in FIG. 1, with its downwardly projecting legs, is preferred since it holds the base off the floor, thus giving an illusion of increased height to the tree. Another embodiment of the invention, employing outwardly directed legs with a stand base which sits adjacent the floor, is illustrated in FIGS. 11 and 12. As shown in FIGS. 11 and 12, the base comprises a pan portion 90, a rim portion 92 and an upstanding peg 93. In this case, the underside of the base is provided with radially extending ribs 95 which terminate in tongue and groove receptacles 96 by means of which the legs 98 are attached to the base. The connection between the legs and the base is illustrated in FIG. 12 which is a perspective view of the bottom of the base showing one leg attached and another leg in a position to be attached to the base.

In the preferred embodiment of the invention, the peg is provided with longitudinally extending splines. The splines function to secure the tree on the stand against relatively rotational movement and to minimize the likelihood of substantial quantities of water entering the interior of the tree and flowing upwardly between the peg surface and the wall of the bore hole. The interior cellular structure of the tree, when initially cut is relatively soft so that the tree may be forced onto the peg in a manner in which the splines will dig into the surface of the wall of the axial bore. This embodiment of the invention is illustrated in FIGS. 13 and 14 which are a side and top views, respectively of a peg 102. As illustrated in FIGS. 13 and 14, the peg is provided with longitudinally extending splines 104 which are tapered somewhat from the bottom 106 to the top 107 of the peg. In addition, the overall peg configuration is tapered slightly from the bottom to the top of the peg.

From a review of the peg configuration shown in FIGS. 13 and 14, it can be seen that the axial bore drilled into the bottom of the tree can be just large enough to accommodate the initial insertion of the peg into the tree. The tree can then be forced down onto the peg with the splines 104 digging into the soft wall of the axial bore. In this respect it can best be seen from examination of FIG. 14 that the width of each spline is relatively small in relation to the circumference of the peg. As the tree is driven down over the peg and the bolt subsequently inserted to pull the tree tight against the base of the stand, a relatively tight fit is achieved between the peg surfaces and the wall of the bore, thus minimizing leakage into the interior of the tree. Particularly in this case, where steps are taken to minimize the flow of fluid into the interior of the tree, it may be desirable to score the outside of the tree in order to prevent the tree from drying out prematurely. In addition, the sawed surface at the butt end of the tree may be notched or scored in order to permit further access of water to the tree.

As shown in FIG. 14, and also in FIG. 5, the peripheral wall of the peg is substantially vertical in order to accommodate the trunk of the tree being driven down over the peg so that the butt end of the tree will rest upon the pan portion of the base. This embodiment of the invention precludes the use of a peg with a substantial taper, as disclosed, for example in the aforementioned patent to Dunbar, which will cause the weight of the tree to be borne entirely by the peg, as in the case of the Dunbar structure. While the peg may have some slight taper as shown in FIG. 13 and hence not be an exact cylinder, the peripheral wall of the peg should not deviate from the vertical by an angle greater than 3° and preferably not greater than 2°.

Having described specific embodiments of the present invention, it will be understood that modification thereof may be suggested to those skilled in the art, and it is intended to cover all such modifications as fall within the scope of the appended claims.

We claim:

1. In a tree stand of the type adapted to support a Christmas tree, the combination comprising:

(a) a stand base having a bottom pan portion and a peripheral rim portion whereby said stand base is adapted to contain water;

(b) a peg extending upwardly from the pan portion of said stand base;

(c) an elongated axial bore extending through said peg from the underside of said pan portion to the top end of said peg;

(d) a bolt receivable within said peg bore and longer than said peg bore whereby, when a tree is in place on said peg, said bolt protrudes from the upper end of said peg to secure the tree to said stand.

2. The combination of claim 1 wherein said peg extends above the lip of said rim.

3. The combination of claim 1 further comprising a plurality of support legs extending outwardly from said stand base.

4. The combination of claim 1 further comprising a plurality of ribs located on the underside of said pan portion to impart structural rigidity to said stand base.

5. The combination of claim 1 further comprising standoff means projecting upwardly from the bottom of said pan portion in the vicinity of said peg to support the butt end of a tree when in place on said peg, off of the bottom of said pan portion by a distance permitting access of water to the butt end of said tree.

6. The combination of claim 5 wherein said standoff means comprises a plurality of ribs extending radially outwardly from said stand base on the upper side of said pan portion.

7. The combination of claim 6 wherein the depth of first mentioned ribs on the underside of said pan portion is greater than the depth of said ribs on the upper side of said pan portion.

8. The combination of claim 7 further comprising a plurality of legs extending outwardly from said stand base and being detachably connected to said stand base at the termination of said structural ribs at said base.

9. The combination of claim 8 wherein said legs extend outwardly and downwardly from said stand base.

10. In a tree stand of the type to adapted to support a Christmas tree, the combination comprising (a) a stand base having a bottom pan portion and a peripheral rim portion, said rim portion extending upwardly from said pan portion whereby said stand base is adapted to contain water and extending downwardly from said pan portion to form a lower peripheral rim portion;

(b) a peg extending upwardly from the pan portion of said stand base and formed integrally therewith;

(c) a downwardly extending projection below said peg and depending from the underside of said pan portion, said projection being formed integrally with said stand base, and (d) a rib assembly on the underside of said pan portion to impart structural rigidity to said stand base, said rib assembly comprising a plurality of ribs secured integrally to said downwardly extending projection and extending radially outward therefrom to said lower peripheral rim portion and formed integrally therewith.

11. The combination of claim 10 further comprising standoff means projecting upwardly from the bottom of said pan portion in the vicinity of said peg to support the butt end of a tree when in place on said peg, off of the bottom of said pan portion by a distance permitting access of water to the butt end of said tree.

12. The combination of claim 11 wherein said stand off means comprises a plurality of ribs extending outwardly from said peg on the upper side of said pan portion, said ribs on the upper side of said pan portion having a depth which is less than the ribs on the underside of said pan portion.

13. The combination of claim 10 further comprising a plurality of legs extending outwardly from said stand base and being detachably connected to said stand base at the termination of said structural ribs at said base.

14. In a Christmas tree display, the combination comprising:

a. a Christmas tree in which the trunk is cut to provide a butt end, an axial bore hole in the trunk of said tree extending upwardly from the butt end thereof;

b. a stand for the support of said tree, said stand comprising a base having a bottom pan portion and a peripheral rim portion whereby said base is adapted to contain water;

c. a peg fromed integrally with said base and extending upwardly from the pan portion of said base and received within said bore in the trunk of said tree;

d. a downwardly extending projection below said peg formed integrally with said base and depending from the underside of said pan portion;

e. a rib assembly of the underside of said pan portion and formed integrally therewith comprising a plurality of ribs extending radially outward from said downward projection; and f. the butt end of said tree being supported directly upon the pan portion of said base to provide that the load imposed by the weight of said tree is predominately supported directly on said pan portion of said base rather than concentrated on said peg.

15. The combination of claim 14 further comprising means for forcing the butt end of said tree downwardly against the pan portion of said base.

16. The combination of claim 14 wherein said peg comprises a plurality of longitudinally extending splines which extend into the wall of the axial bore within the trunk of said tree.

17. The combination of said 14 wherein the peripheral wall of said peg is substantially vertical and does not deviate from the vertical by an angle greater than 3°.

18. In a Chrismas tree packaging system, the combination comprising:

a. an elongated receptacle;

b. a Christmas tree within said receptacle;

c. a stand base secured to the trunk of said tree at the butt end thereof;

d. said stand base comprising a pan portion and a peg extending upwardly from said pan portion and received within a hole extending upwardly into the trunk of said tree from the butt end thereof, e. an axial bore extending through said peg from one end to the other end thereof f. a bolt extending through said peg bore and into the trunk of said tree to secure said stand to said tree, and g. means securing said stand base and said tree within said receptacle against relative longitudinal movement between said tree and said receptacle during transportation of said packaging system.

19. The combination of claim 18 further comprising a flexible strap extending from the bottom of said stand base to facilitate the withdrawal of said tree-stand combination from said receptacle.

20. The combination of claim 19 wherein said strap is secured to said bolt.

21. In a Christmas tree display, the combination comprising:

a. a Christmas tree in which the trunk is cut to provide a butt end, an axial bore hole in the trunk of said tree extending upwardly from the butt end thereof;

b. a stand for the support of said tree, said stand comprising a base having a bottom pan portion and a peripheral rim portion whereby said base is adapted to contain water;

c. a peg formed integrally with said base and extending upwardly from the pan portion of said base and received within said bore in the trunk of said tree;

d. the butt end of said tree being supported directly upon the pan portion of said base to provide that the load imposed by the weight of said tree is predominately supported directly on said pan portion of said base rather than concentrated on said peg;

e. means for forcing the butt end of said tree downwardly against the pan portion of said base comprising a bolt extending upwardly through an elongated axial bore in said peg and into the interior of said tree, said bolt being stressed in tension to pull said tree downwardly against the pan portion of said base.

* * * * *